US006439914B2

(12) United States Patent
Nimura

(10) Patent No.: US 6,439,914 B2
(45) Date of Patent: Aug. 27, 2002

(54) CONNECTOR HAVING A SHORT-CIRCUITING ELEMENT

(75) Inventor: Kazuhiko Nimura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/736,172

(22) Filed: Dec. 15, 2000

(30) Foreign Application Priority Data

Jan. 7, 2000 (JP) ..... 2000-001717

(51) Int. Cl.[7] ..... H01R 13/627
(52) U.S. Cl. ..... 439/352; 439/489
(58) Field of Search ..... 439/352, 350, 439/489, 488

(56) References Cited

U.S. PATENT DOCUMENTS 6,276,953 B1 * 8/2001 Gauker et al. ..... 439/352

FOREIGN PATENT DOCUMENTS

| | | |
|---|---|---|
| DE | 196 17 820 | 11/1997 |
| EP | 734100 | 9/1996 |
| EP | 734101 | 9/1996 |
| EP | 902 506 | 3/1999 |

* cited by examiner

*Primary Examiner*—Renee Luebke
(74) *Attorney, Agent, or Firm*—Banner & Witcoff, Ltd.

(57) ABSTRACT

The invention provides an electrical connector with a reduced number of components and improved operability. As a fitting detecting member 40 is moved from a detecting position to a waiting position, releasing members 52 of a short-circuit releasing member 50 return, due to their own resilient returning force, from a short-circuit releasing position to a position allowing short-circuiting to occur. A separate means is not required to return the releasing members 52 to the position allowing short-circuiting to occur. Consequently, the number of components required is reduced. After two housings 10 and 20 have been fitted together, moving the fitting detecting member 40 from the waiting position to the detecting position pushes the releasing members 52 from the position allowing short-circuiting to occur to the short-circuit releasing position. That is, both the detecting operation of the fitting detecting member 40 and the short-circuit releasing operation of the short-circuit releasing member 50 are performed with a single action, thereby improving operability.

9 Claims, 9 Drawing Sheets

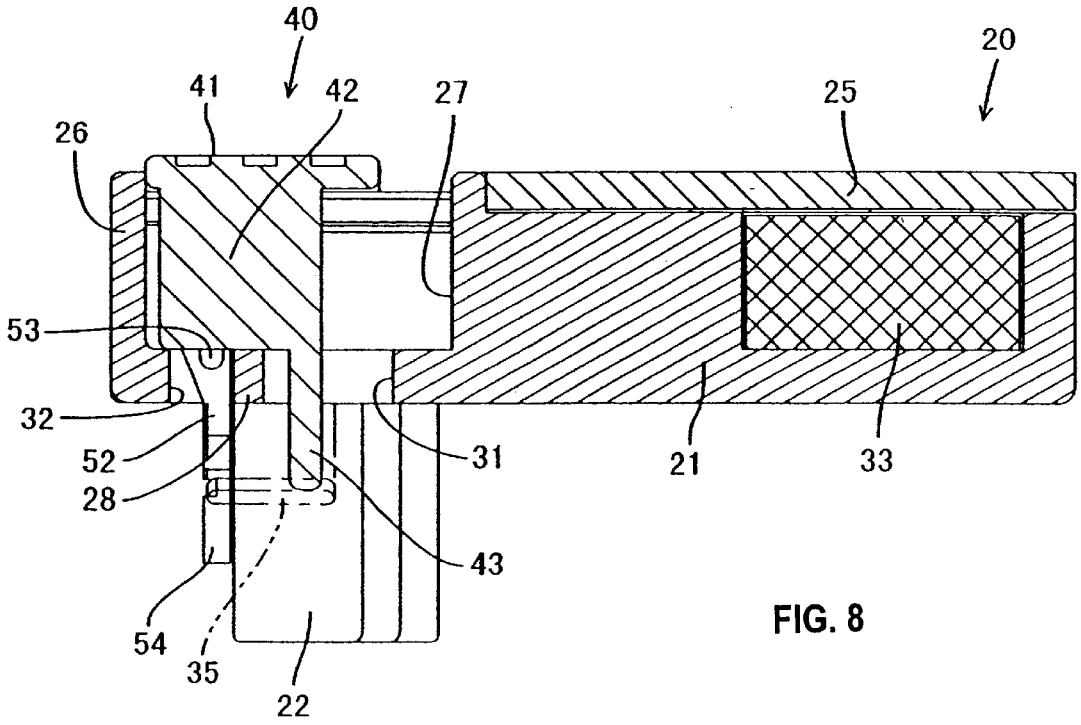
FIG. 8
FIG. 9
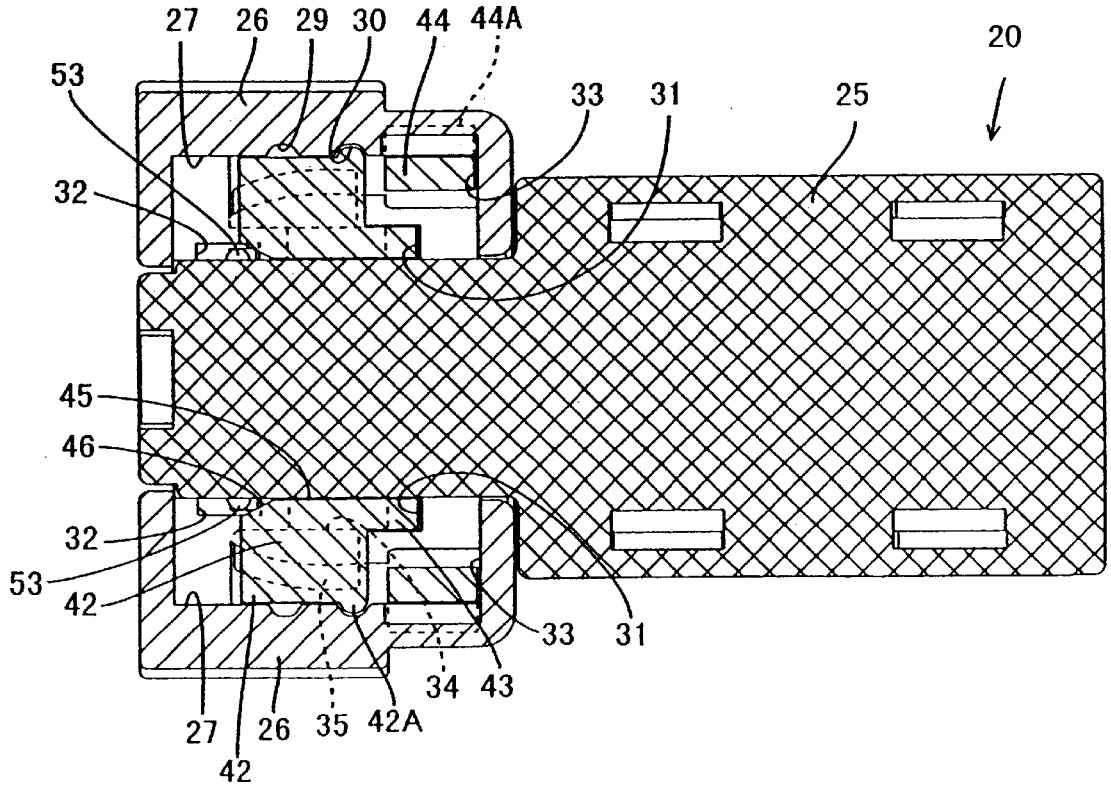

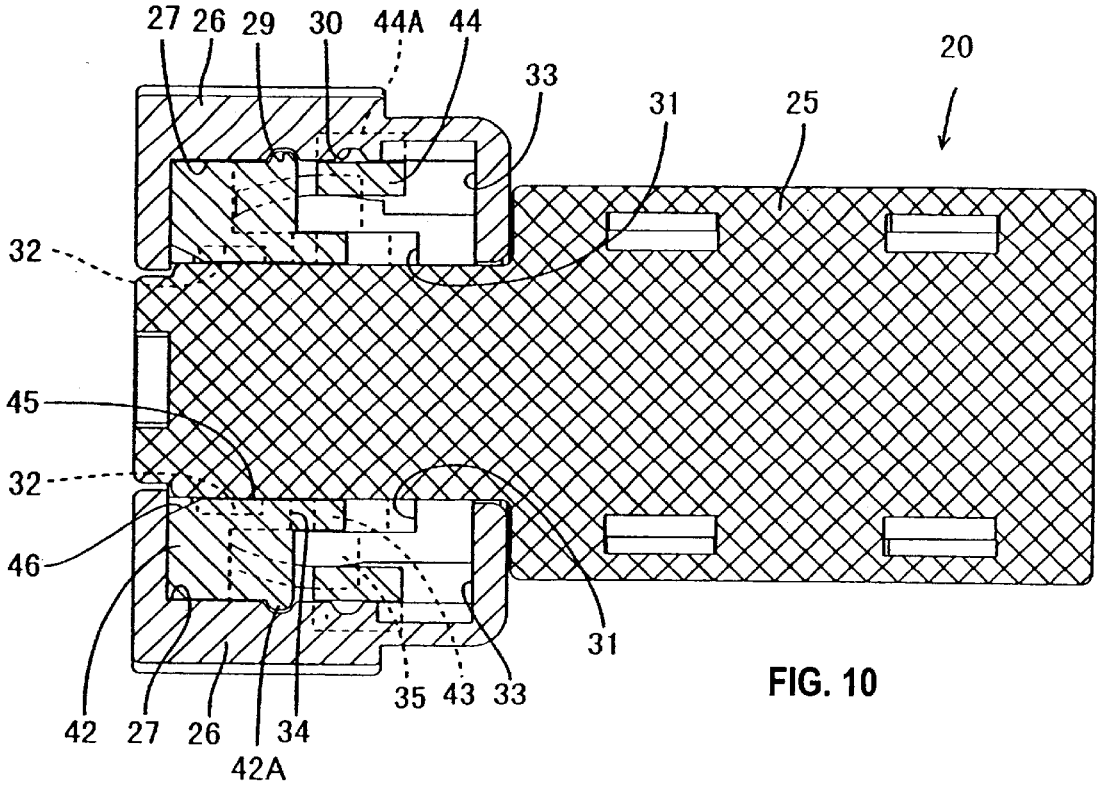
FIG. 10
FIG. 11
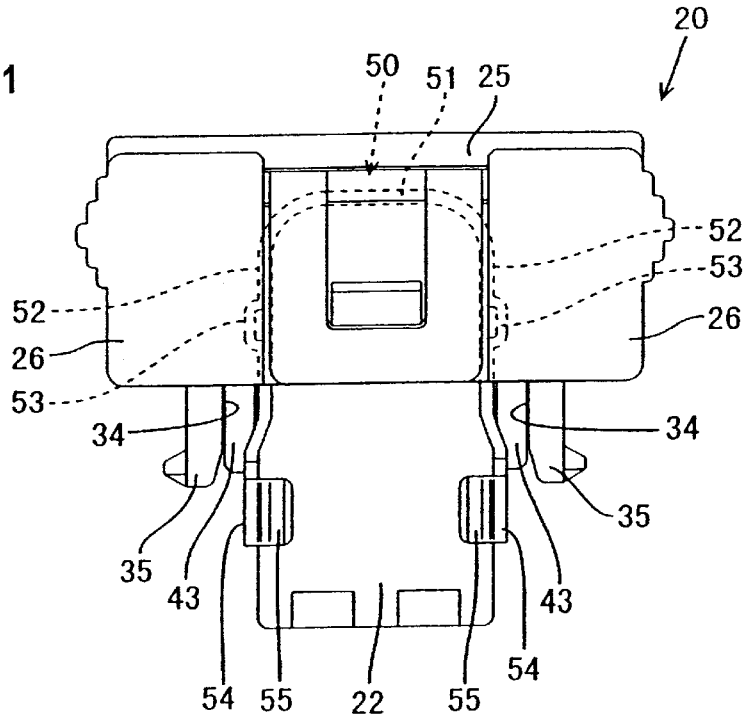

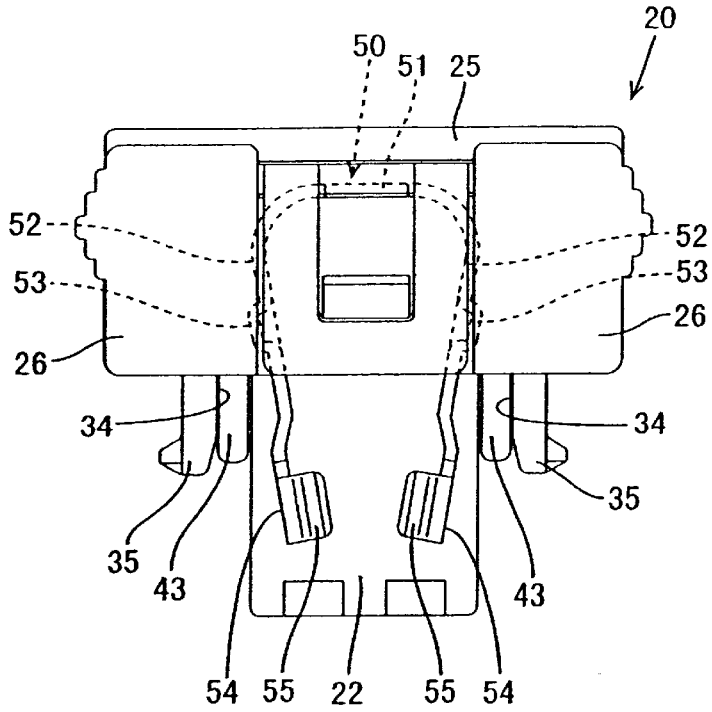
FIG. 12
FIG. 13
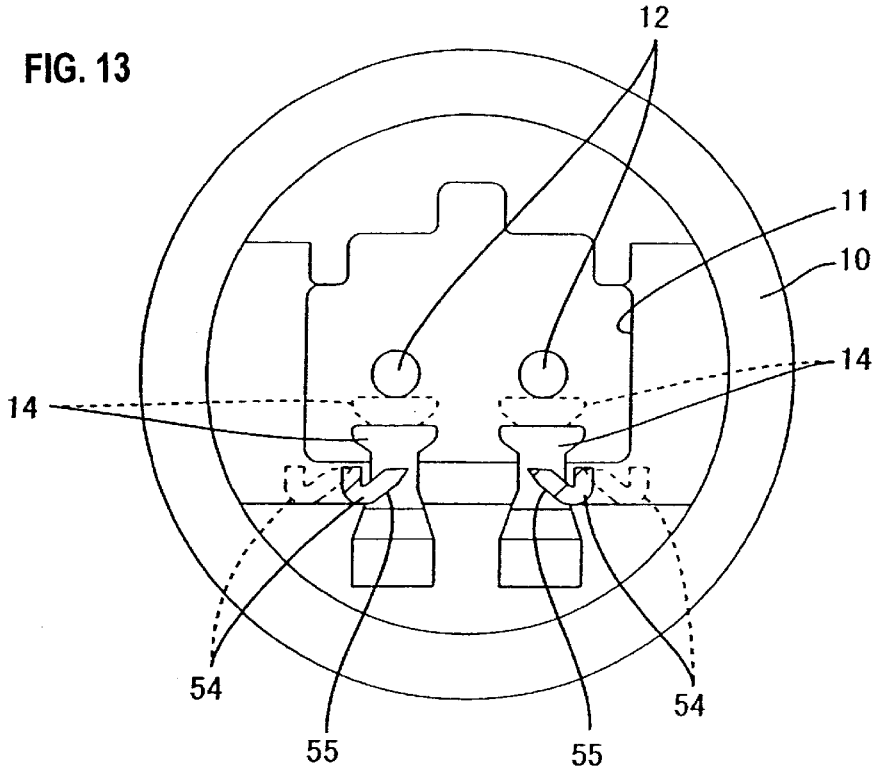

CONNECTOR HAVING A SHORT-CIRCUITING ELEMENT

TECHNICAL FIELD

The present invention relates to an electrical connector.

BACKGROUND TO THE INVENTION

JP 11-149958 describes a connector provided with a function for detecting the fitted state of connector housings and capable of releasing a short-circuiting state of terminal fittings of a first connector housing by means of a short-circuit releasing member provided on a second connector housing.

As shown in FIGS. 15 and 16 of this specification, when two housings 101 and 102 are in separated state, terminal fittings 103 of the first housing 101 are short-circuited by shorting terminals 104, and a fitting detecting member 105 and a short-circuit releasing member 106 are attached to the second housing 102 in a temporarily retained state. When attachment is to take place, the two housings 101 and 102 are first fitted together. Next, the short-circuit releasing member 106 is pushed in towards a return spring 107, thereby releasing the short-circuiting state. Finally, the fitting detecting member 105 is pushed in. Pushing in the fitting detecting member 105 causes a retaining member 105A thereof to engage with a retaining member 106A of a short-circuit releasing member 106, this short-circuit member 106 being locked in a state whereby it is pressed against the return spring 107. The return spring 107 is not shown in FIG. 16 for reasons of clarity.

If the two housings 101 and 102 are in a half-fitted state, a locking member (not shown) is bent to a wrong position and interferes with the fitting detecting member 105, preventing the fitting detecting member 105 from being pushed in. By this means, the half-fitted state can be detected. Furthermore, if one lets go of the short-circuit releasing member 106 which has been pushed in, the return spring 107 pushes the short-circuit releasing member 106 out to a temporary retaining position, and the terminal fittings 103 return to their short-circuiting state.

When the two housings 101 and 102 are to be released from their fitted state, the fitting detecting means 105 is moved from a detecting position to a waiting position. This causes the engagement of the retaining members 105A and 106A to be released, the return spring 107 moves the short-circuit releasing member 106 from a short-circuit releasing position to a position allowing short-circuiting to occur, and the terminal fittings 103 are short-circuited.

In the conventional connector, the return spring 107 is the means to return the short-circuit releasing member 106 to the position allowing short-circuiting to occur. This return spring 107 is provided as a component separate from the short-circuit releasing member 106. Consequently, there is a problem that the number of components is large.

Furthermore, separate operations are required to push in the fitting detecting member 105 and the short-circuiting member 106, and operability is consequently poor.

SUMMARY OF THE INVENTION

According to the invention there is provided an electrical connector comprising two housings adapted for mutual fitting and having a resilient latch movable to a locking position to retain said housings in a fitted condition, and movable to non-locking position during movement of said housings through a half-fitted condition, the connector including a detecting member provided on one of said housings and movable from a retracted to an advanced position, the latch preventing movement of the detecting member when in the non-locking position, and permitting movement of the detecting member when in the locking position, and the connector further including a short-circuit releasing member adapted to cause or release a short-circuit condition between terminals of the other of said housings, wherein said short-circuit releasing member is engageable by said detecting member on movement from the retracted to the advanced condition, to move from a short-circuiting condition to a state in which the short-circuit condition is released. Preferably the short-circuit releasing member includes a resilient arm which deflects during movement of the detecting member from a retracted to an advanced condition.

The short-circuit releasing member is preferably 'U' shaped, having two such resilient arms, and insertable in one of said housings in the direction of the engagement axis of the housings. A projection of this 'U' shaped member is preferably engageable in a corresponding aperture of the associated housing to prevent lateral movement thereof. The arms of the 'U' shaped member are preferably deflectable apart to release the short-circuit condition, the tips of the arms preferably having a ramp surface for engagement with a short-circuit member and for moving the short-circuit member from a short-circuiting to a non-short circuiting condition.

BRIEF DESCRIPTION OF DRAWINGS

Other features of the invention will be apparent from the following description of a preferred embodiment shown by way of example only in the accompanying drawings in which:

FIG. 8 is a vertical cross-sectional view of the fitting detecting member which has been moved to the detecting position.

FIG. 9 is a horizontal cross-sectional view of the fitting detecting member in the waiting position.

FIG. 10 is a horizontal cross-sectional view of the fitting detecting member which has been moved to the detecting position.

FIG. 11 is a front view of releasing members of the short-circuit releasing member which are in a position allowing short-circuiting to occur.

FIG. 12 is a front view of the releasing members of the short-circuit releasing member which have moved to a short-circuit releasing position.

FIG. 13 is a plan view showing the short-circuit releasing operation of the releasing member.

DESCRIPTION OF PREFERRED EMBODIMENT

A connector of the present embodiment is provided with a male housing 10 and a female housing 20, these two housings 10 and 20 being capable of fitting mutually together and of being separated.

Figure 14:
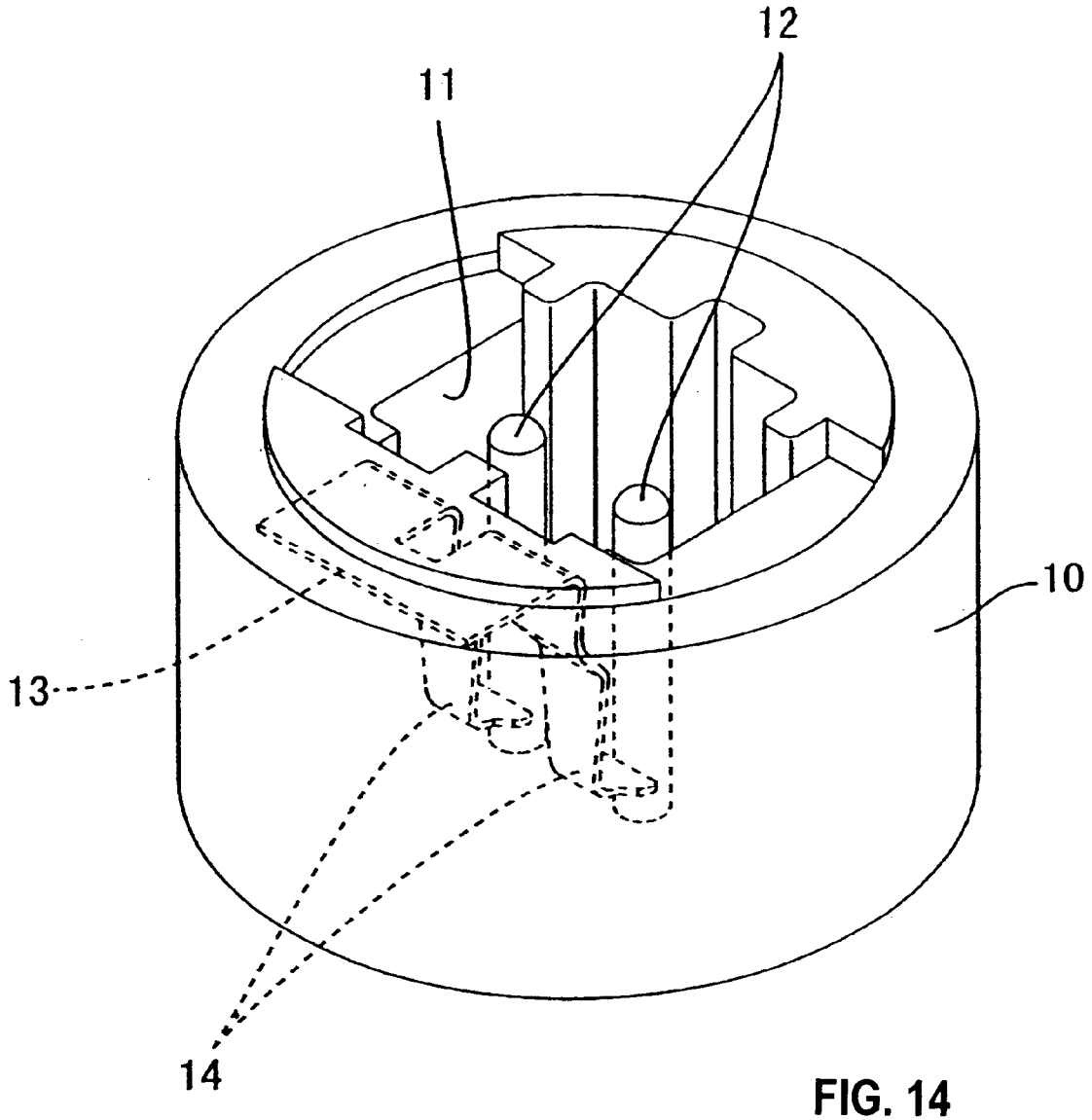
FIG. 14 is a diagonal view of a male housing.
Figure 16:
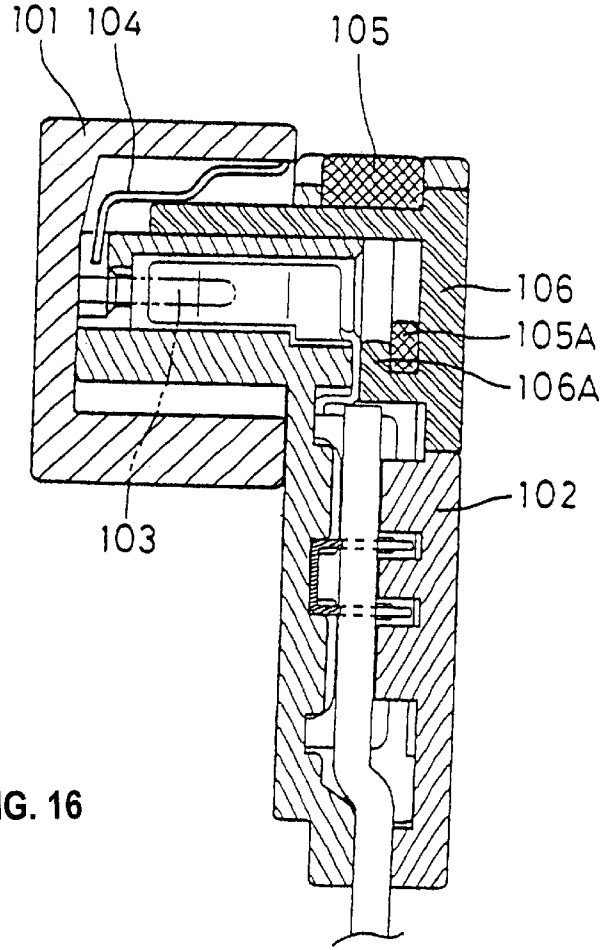
FIG. 16 PRIOR ART
FIG. 16 is a cross-sectional view of the conventional example.
Figure 15:
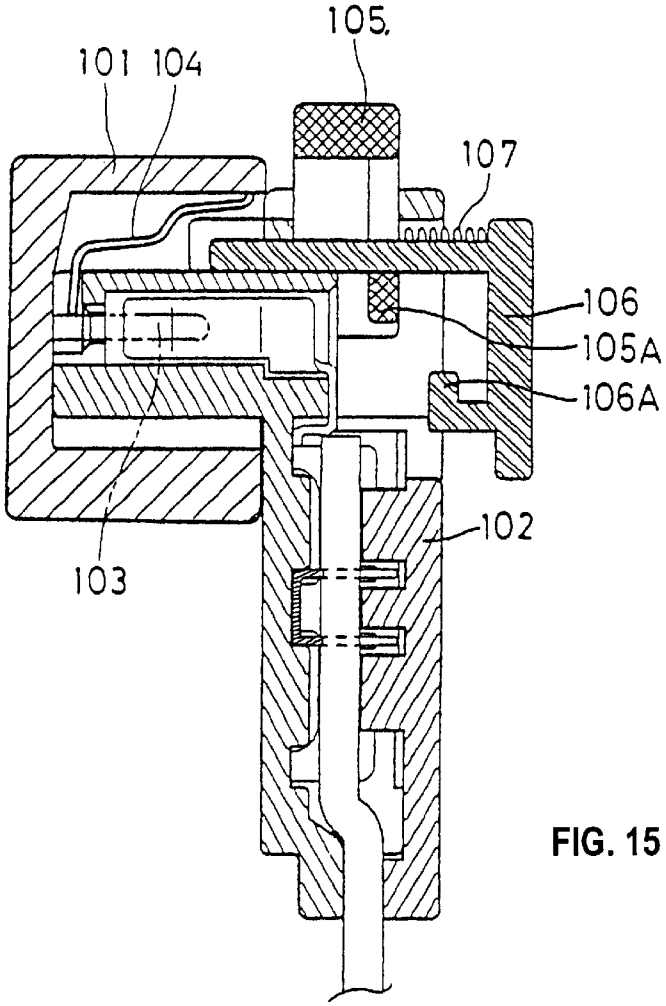
FIG. 15 is a cross-sectional view of a conventional example.

The male housing 10 is made from plastic. As shown in FIGS. 13 and 14, this male housing 10 has a recess 11 opening onto its upper face. A left and right pair of upwardly protruding male terminal fittings 12 (the terminal fittings of the present invention) and a shorting terminal 13 are housed within this recess 11. The shorting terminal 13 has a pair of resilient contacts 14 capable of making resilient contact with the side with the male terminal fittings 12. When the two housings 10 and 20 are in a separated state, the pair of resilient contacts 14 make contact with the pair of male terminal fittings 12, causing a short-circuiting state therebetween. Furthermore, as will be explained, when the two housings 10 and 20 are fitted together, the resilient contacts 14 are bent by a short-circuit releasing member 50 so as to become separated from the male terminal fittings 12, thereby releasing the short-circuiting state of the two male terminal fittings 12.

The female housing 20 is provided with a left and right pair of female terminal fittings 60 capable of making contact with the male terminal fittings 12, a ferrite core 63, the short-circuit releasing member 50, and a fitting detecting member 40. The female housing 20 is made from plastic, and is composed of a main body 21 which is long in an anterior-posterior direction, and a fitting member 22 which extends downwards from an anterior end of the main body 21 and which fits into the recess 11 of the male housing 10. A cavity 23 is formed within the main body 21 and the fitting member 22, this cavity 23 having an L-shape when viewed from the side and being open to an upper face of the female housing 20. Housed within the cavity 23 are the female terminal fittings 60, ends of electric wires 61 that are connected to the female terminal fittings 60, and the ferrite core 63. Further, the open portion of the cavity 23 is covered by a cover 25 that is joined to the female housing 20 by a hinge 24.

The female terminal fittings 60 have an L-shape when viewed from the side, the posterior ends thereof being crimped to the electric wires 61. When the two housings 10 and 20 are fitted together, downwardly protruding box-shaped members 62 of the female terminal fittings 60 fit with the male terminal fittings 12. The ferrite core 63, which is for noise reduction, has a left and right pair of attachment holes 64 passing therethrough in an anterior-posterior direction, the electric wire 61 passing through these attachment holes 64.

Attachment of the Fitting Detecting Member 40 and the Short-Circuit Releasing Member 50 to the Female Housing A pair of left and right side walls 26 are formed at an anterior end portion of the main body 21 of the female housing 20, and attachment spaces 27 are formed between the anterior end portion of the main body 21 and outer side faces of the side walls 26. Approximately the entirety of the upper faces of the attachment spaces 27 formed from the side walls 26 is open, lower faces thereof forming base walls 28 which have portions thereof open. A detecting position stopping groove 29 and a waiting position stopping groove 30 are formed in two locations, at the anterior and posterior respectively, of each of left and right inner side faces of the side walls 26. Stopping ribs 42A of the fitting detecting member 40 can fit into the detecting position stopping grooves 29 and the waiting position stopping grooves 30. Detecting member escape holes 31, releasing member escape holes 32 and stopping member escape holes 33 are formed in the base walls 28. These detecting member escape holes 31 open out along outer side faces of the main body 21 of the female housing 20. The releasing member escape holes 23 also open out along the outer side faces of the main body 21 and are located to the anterior of the detecting member escape holes 31. The stopping member escape holes 33 open out along the left and right side faces of the side walls 26.

Furthermore, a locking member 35 extends downwards from each base wall 28. Each locking member 35 has a detecting space 34 which allows detecting members 43 to be fitted between the locking members 35 and the outer side faces of the main body 21 with only a small space remaining therebetween. While the male housing 10 is in the process of being fitted with the female housing 20, the locking members 35 make contact with lock receiving members (not shown) of the male housing 10, and are thereby bent inwards. When the two housing 10 and 20 reach a correctly fitted state, the locking members 35 return, as a result of their own resilient returning force, to their original position, leaving the detecting spaces 34 empty.

The fitting detecting member 40 is composed of a horizontal upper face plate 41, a pair of guiding members 42 that extend downwards from anterior ends of left and right side edges of the upper face plate 41, the detecting members 43 that protrude downwards from posterior ends of the guiding members 42, and a pair of stopping members 44 that protrude downwards from posterior ends of the left and right side edges of the upper face plate 41. Inner faces of the guiding members 42 form pressing faces 45 for pressing releasing members 52 (to be explained) of the short-circuit releasing member 50. Anterior ends of these pressing faces 45 form guiding inclined faces 46 which are taper shaped when viewed from above. Furthermore, the pressing faces 45 join in a unified manner with inner faces of the detecting members 43. The stopping ribs 42A are formed on outer faces of the guiding members 42. These stopping ribs 42A maintain the fitting detecting member 40 in a waiting position and a detecting position.

After the cover 25 is closed, the fitting detecting member 40 is attached to the female housing 20 with the guiding members 42, the detecting members 43, and the stopping members 44 fitting from above into the attachment spaces 27, and the upper face plate 41 covering an upper face of the cover 25. In the attached state, the stopping members 44 bend resiliently inwards, stopping protrusions 44A located at lower ends thereof passing through the stopping member escape holes 33. These stopping protrusions 44A engage with edges of the stopping member escape holes 33, thereby preventing the fitting detecting member 40 from moving upwards relative to the female housing 20. Further, the inner and outer faces of the guiding members 42 are adjacent, respectively, to the outer side faces of the main body 21 above the base walls 28 and inner side faces of the side walls 26. Consequently, the fitting member 40 is prevented from moving to the left or right of the female housing 20. Moreover, the stopping ribs 42A fit into the waiting position stopping grooves 30, thereby maintaining the fitting detecting member 40 in the waiting position without its moving to the anterior or posterior. The fitting detecting member 40, which is maintained in the waiting position, can be moved horizontally in an anterior direction to the detecting position, the side walls 26 bending resiliently outwards and the stopping ribs 42A make sliding contact with inner faces thereof. The stopping ribs 42A then fit with the detecting position stopping grooves 29, thereby maintaining the fitting detecting member 40 in the detecting position without its moving to the anterior or posterior.

Figure 1:
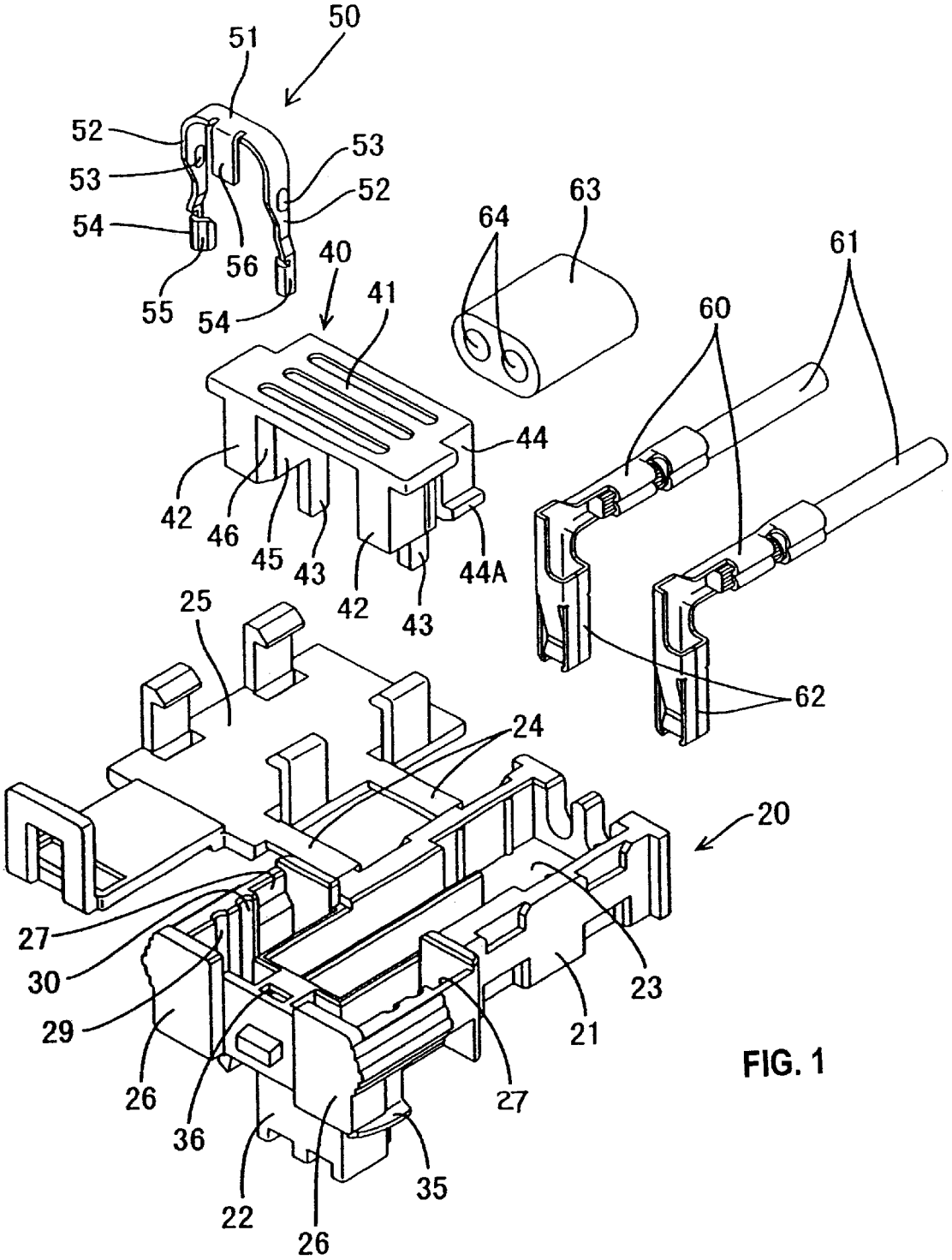
FIG. 1 is a disassembled diagonal view of embodiment 1.
Figure 3:
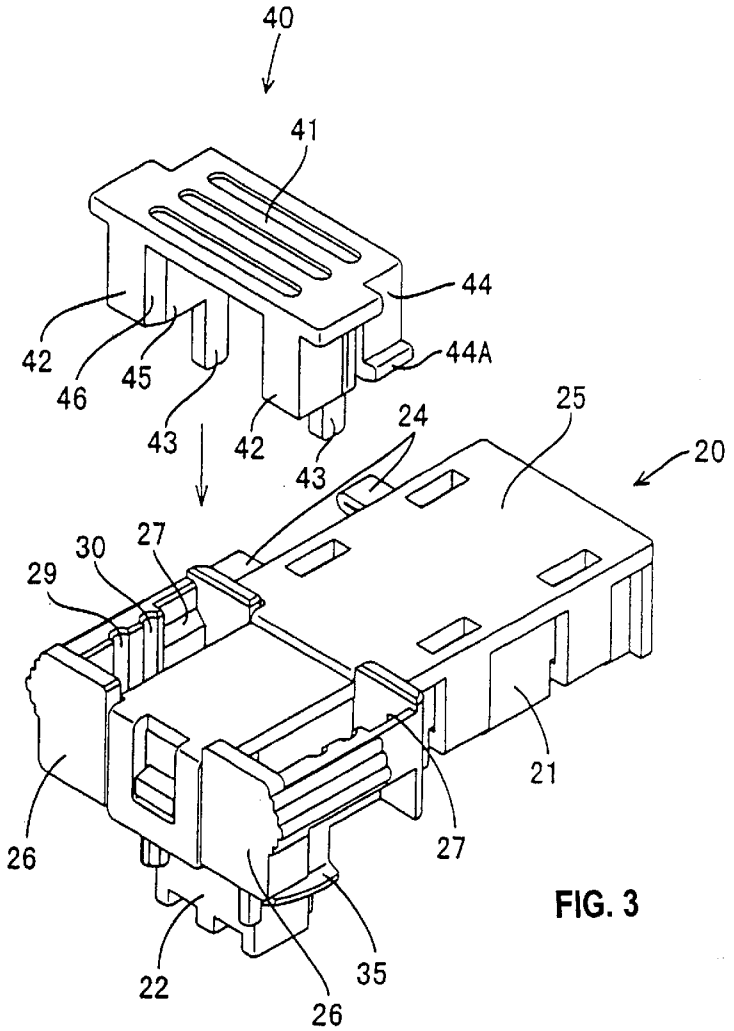
FIG. 3 is a diagonal view of the female housing covered by a cover.
Figure 2:
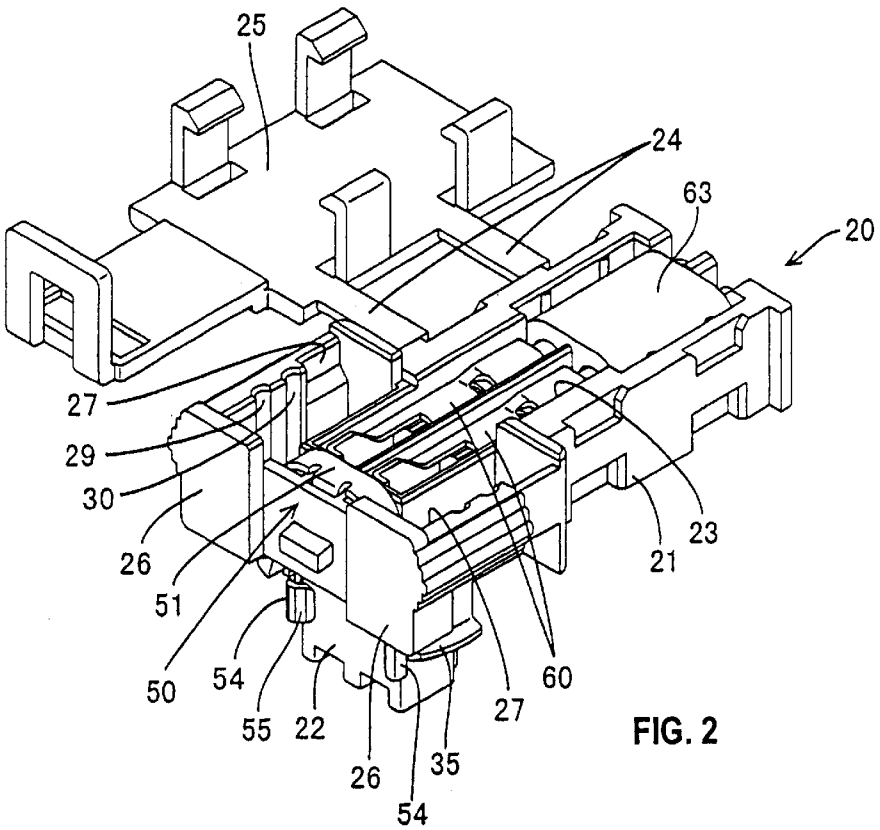
FIG. 2 is a diagonal view of a short-circuit releasing member and female terminal fittings attached to a female housing.
Figure 5:
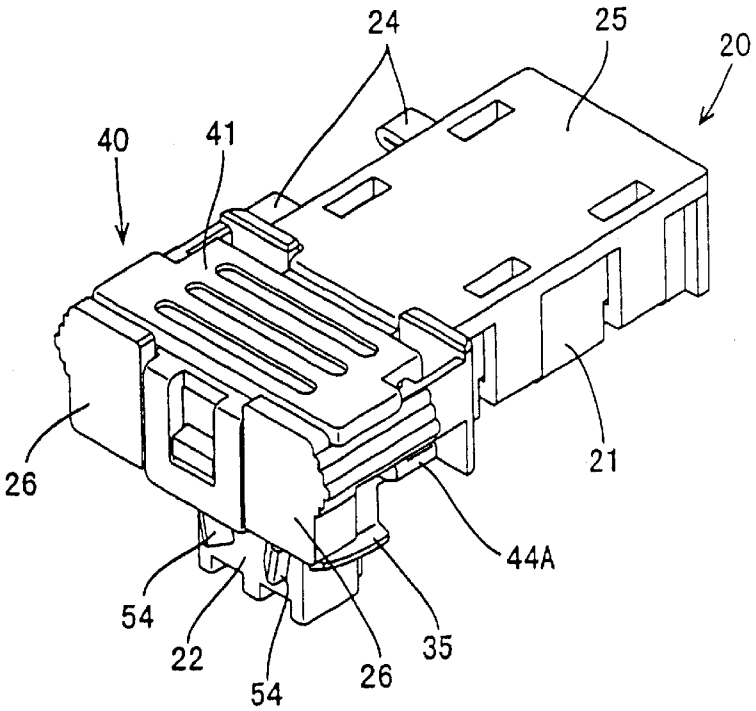
FIG. 5 is a diagonal view of the fitting detecting member which has been moved to a detecting position.
Figure 4:
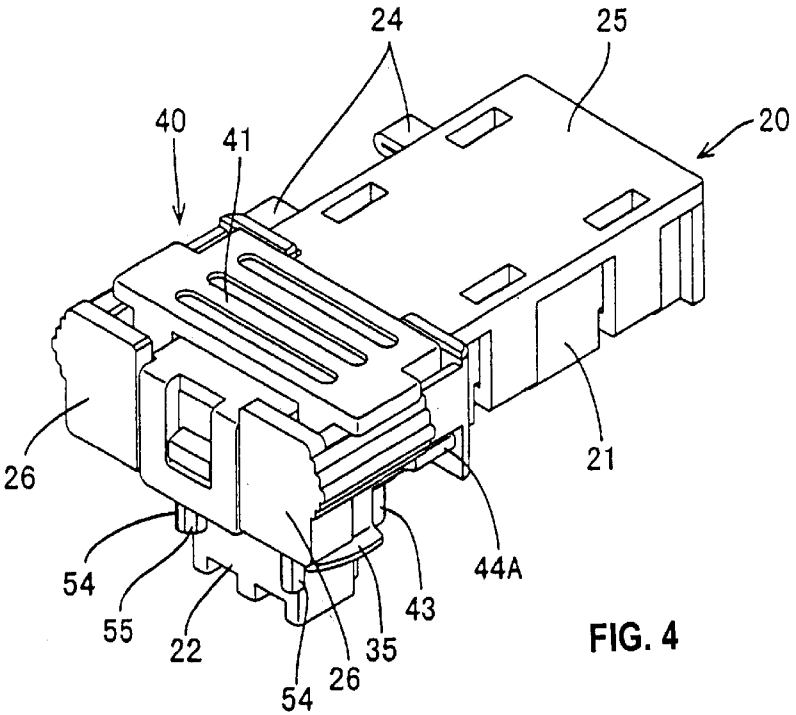
FIG. 4 is a diagonal view of a fitting detecting member attached in a waiting position.
Figure 6:
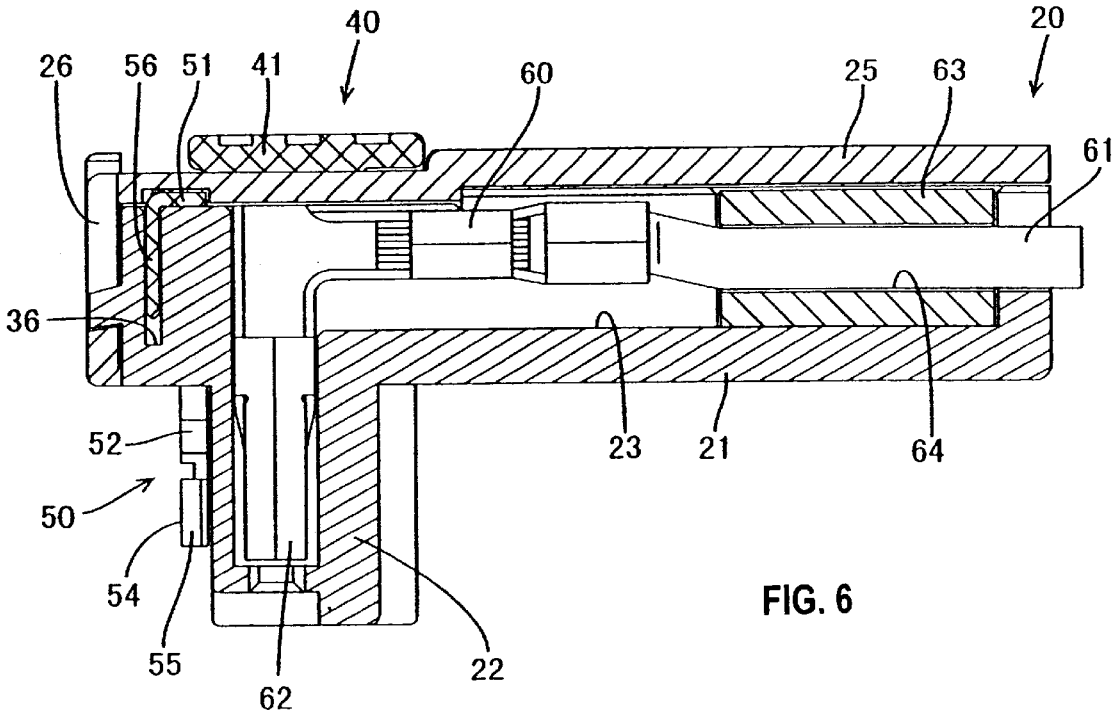
FIG. 6 is a vertical cross-sectional view of the fitting detecting member in the waiting position.
Figure 7:
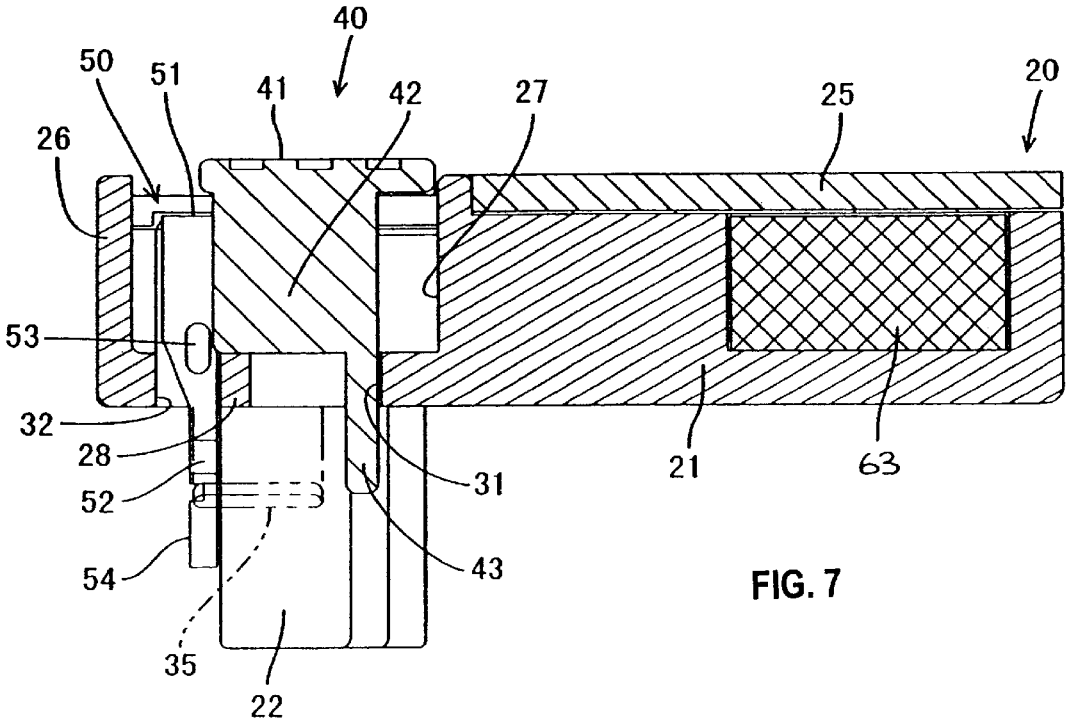
FIG. 7 is a vertical cross-sectional view of the fitting detecting member in the waiting position.

The detecting members 43 pass through the detecting member escape holes 31 and protrude downwards from the base walls 28. These detecting members 43 are located so as to fit into the detecting spaces 34 positioned between the locking members 35 (which are in a free state when viewed from their front faces) and the main body 21. When the fitting detecting member 40 is in the waiting position, the detecting members 43 are located to the posterior of the locking members 35 when viewed from the side (the right side in FIG. 7). However, when the fitting detecting member 40 has been moved to the detecting position, the detecting members 43 enter the detecting spaces 34 and overlap with the locking members 35 when viewed from the side. Furthermore, as the two housings 10 and 20 are being fitted together and the locking members 35 are in a state whereby they are bent inwards so as to enter the detecting spaces 34 (that is, in a half-fitting state), the detecting members 43 make contact with posterior ends of the locking members 35, thereby preventing the locking members 35 from entering the detecting spaces 34. Consequently, the fitting detecting member 40 is prevented from entering the detecting position.

Short-Circuit Releasing Member

The short-circuit releasing member 50, which has an inverted U-shape when viewed from the anterior, is formed in a unified manner from an attachment member 51 that is long and narrow in a left-right direction, and the pair of releasing members 52 that protrude downwards in a mutually parallel manner from left and right ends of the attachment member 51. The releasing members 52 are usually in a position allowing short-circuiting to occur, but are capable of being bent resiliently inwards relative to the attachment member 51 (that is, the releasing members 52 are bent towards one another) to a short-circuit releasing position. The releasing members 52 return from the short-circuit releasing position to the position allowing short-circuiting to occur due to their own resilient returning force. The short-circuit releasing member 50 may be made from either metal or plastic.

Pressing protrusions 53 are formed on both outer faces of the releasing members 52. These pressing protrusions 53 are formed at height allowing them to engage with the pressing faces 45 of the fitting detecting member 40. Contacting members 54 extend inwards from anterior edges of lower ends of the releasing members 52. These contacting members 54 have guiding inclined faces 55 which are taper shaped when viewed from above. The space between both inner sides of the contacting members 54 is usually (that is, when the releasing members 52 are in the position allowing short-circuiting to occur) greater than the dimensions between outer sides of the pair of resilient contacts 14 of the shorting terminal circuit 13 of the male housing 10. However, when the releasing members 52 are in a state whereby they have been moved to the short-circuit releasing position, the pitch between the contacting members 54 is the same as the pitch between the resilient contacts 14. That is, when the short-circuit releasing member 50 is in the short-circuit releasing position, the contacting members 54 do not make contact with the resilient contacts 14 of the shorting terminal 13 even if the two housings 10 and 20 are correctly fitted together. However, when the short-circuit releasing member 50 is moved resiliently to the short-circuit releasing position when the two housings 10 and 20 are correctly fitted together, the contacting members 54 engage from the sides with the resilient contacts 14 and press these towards the anterior (in a direction away from the male terminal fittings 12) by means of the guiding inclined faces.

The short-circuit releasing member 50 is attached by fitting an attachment protrusion 56, which extends downwards from an anterior edge of the attachment member 51, into an attachment groove 36 of the female housing 20, and by inserting the two releasing members 52 into the attachment spaces 27. The attachment operation of the short-circuit releasing member 50 is performed before the fitting detecting member 40 is attached and before the open portion of the cavity 23 is covered by the cover 25. After the fitting detecting member 50 has been attached, the cover 25 pressed down on the attachment member 51 thereof from above, thereby preventing the fitting detecting member 50 from moving upwards. The attachment protrusion 56 fits into the attachment groove 36, thereby preventing the fitting detecting member 50 from moving in an anterior-posterior or left-right direction.

When the short-circuit releasing member 50 is in the attached state, the releasing members 52 pass through the releasing member escape holes 32 and extend downwards. Viewed from above, the outer faces of the releasing members 52 are located in approximately the same position as the outer side faces of the main body 21, the pressing protrusions 53 protruding outwards relative to the outer side faces of the main body 21 so as to be located in a position whereby they can make contact with the pressing faces 45. When the fitting detecting member 40 is in the waiting state, the pressing protrusions 53 are located in the vicinity of the guiding inclined faces 46 at the anterior ends of the guiding members 42. When the fitting detecting member 40 is moved from the waiting position to the detecting position, the pressing faces 45 make contact with the pressing protrusions 53, and as a result the releasing members 52 are pushed in resiliently from the position allowing short-circuiting to occur to the short-circuit releasing position.

As the short-circuit releasing member 50 is moving from the waiting position to the detecting position, the guiding inclined faces 46 and the pressing faces 45 make contact with the pressing protrusions 53 before the anterior edges of the detecting members 43 of the fitting detecting member 40 reach the posterior edge of the locking member 35, and the releasing members 52 are moved to the short-circuit releasing position.

When the two housings 10 and 20 are to be fitted together, the fitting member 22 is fitted into the recess 11 while the fitting detecting member 40 is in a state whereby it has been moved to the waiting position. During this fitting operation, the locking members 35 are bent temporarily inwards from a locking position to a non-locking position. When the two housings 10 and 20 reach the correctly fitted state, the locking members 35 return resiliently to the locking position, thereby locking the two housings 10 and 20 in an inseparable state. In this state, the releasing members 52 of the short-circuit releasing member 50 are in the position allowing short-circuiting to occur. Consequently, the male terminal fittings 12 of the male housing 10 are short-circuited by the shorting terminal 13.

Next, the fitting detecting member 40 is slid to the anterior to the detecting position. Immediately after this sliding operation has begun, the guiding inclined faces 46 and the pressing faces 45 of the fitting detecting member 40 make contact in turn with the pressing protrusions 53. As the fitting detecting member 40 is being slid, the releasing members 52 are pressed resiliently into the short-circuit releasing position. As the releasing members 52 move, the guiding inclined faces 53 of the contacting members 54 of the releasing members 52 make contact from the sides with the resilient contacts 14 of the shorting terminal 13. These guiding inclined faces 55 press against the resilient contacts 14, causing them to bend away from the male terminal fittings 12. By this means, the short-circuiting state of the male terminal fittings 12 is released.

In this short-circuit releasing state, the resilient returning force of the resilient contacts 14 exerts a pushing force in a posterior direction on the contacting members 54 of the short-circuit releasing member 50. However, when the releasing members 52 are in the short-circuit releasing position, the releasing members 52 and the contacting members 54 are located so as to make contact with the anterior end face of the main body 21 of the female housing 20. Consequently, the releasing member 52 and the contacting members 54 are prevented from moving to the posterior, and the resilient contacts 14 are reliably maintained in a position whereby they do not make contact with the male terminal fittings 12.

Furthermore, the short-circuit releasing operation of the short-circuit releasing member 50 is completed before the fitting detecting member 40 reaches the detecting position. After the short-circuit releasing operation is completed, the insertion begins of the detecting members 43 of the fitting detecting member 40 into the detecting spaces 34 between the locking members 35 and the main body 21. When the fitting detecting member 40 reaches the detecting position, the stopping ribs 42A fit with a click into the detecting position stopping grooves 29 located at the anterior. This click informs the operator that the fitting detecting member 40 has reached the detecting position and, simultaneously, the fact of the fitting detecting member 40 reaching the detecting position informs the operator that the two housings 10 and 20 are correctly fitted together. In this manner, the fitting operation of the two housings 10 and 20, the short-circuit releasing operation of the male terminal fittings 12, and the fitting detecting operation of the two housings 10 and 20 are all completed.

In the case where the two housings 10 and 20 are in a half-fitted state, the locking members 35 are in the non-locking position within the detecting spaces 34. As a result, immediately after the fitting detecting member 40 has been slid a short way towards the detecting position, the detecting members 43 strike against posterior ends of the locking members 35 which are in the non-locking position, thereby preventing the fitting detecting member 40 from moving further towards the anterior. The fact that the fitting detecting member 40 has moved less than the correct distance will inform the operator that the two housings 10 and 20 are in a half-fitted state. Furthermore, the click that accompanies the stopping ribs 42A fitting into the anterior located detecting position stopping grooves 29 will not be heard, thereby allowing the half-fitted state to be detected.

When the two housings 10 and 20, which have been fitted together correctly, are to be separated, the fitting detecting member 40 is first slid towards the posterior from the detecting position to the waiting position. Simultaneously, the pressing faces 45 and the guiding inclined faces 46 of the fitting detecting member 40 are separated, in turn, from the pressing protrusions 53. As a result, the releasing members 52, due to their own resilient returning force, move resiliently outwards from the short-circuit releasing position to the position allowing short-circuiting to occur. As the releasing members 52 return to their original position, the contacting members 54 are released, in an outwards direction, from the resilient contacts 14. The resilient contacts 14 move towards the posterior due to their own resilient returning force and make contact with the male terminal fittings 12. Consequently, the male terminal fittings 12 are again in the short-circuiting state.

When the fitting detecting member 40 is moved from the detecting position to the waiting position, the releasing members 52 of the short-circuit releasing member 50 move as a result of their resilient returning force from the short-circuiting releasing position to the position allowing short-circuiting to occur. Consequently, a separate means for moving the releasing members 52 to the position allowing short-circuiting to occur is not required. By this means, the number of components is reduced. Furthermore, when the two housings 10 and 20 have been fitted together, the releasing members 52 are pushed from the position allowing short-circuiting to occur to the short-circuit releasing position as the fitting detecting member 40 is moved from the waiting position to the detecting position. Consequently, both the detecting operation of the fitting detecting member 40 and the short-circuit releasing operation are performed with a single action. By this means, operability is improved.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the detecting operation of the fitting detecting member automatically moves the releasing members of the short-circuit releasing member to the short-circuit releasing position. However, in the invention, the short-circuit releasing operation and the fitting detecting operation may equally well be performed separately.

(2) In the embodiment described above, the releasing members are capable of returning to the position allowing short-circuiting to occur as a result of their own resilient returning force. However, in the invention, the releasing members may equally well be returned to the position allowing short-circuiting to occur by a spring means that is separate from the releasing members.

What is claimed is:

1. An electrical connector, comprising two housings adapted for mutual fitting and having a resilient latch movable to a locking position to retain said housings in a fitted condition, and movable to a non-locking position during movement of said housings, through a half-fitted condition, the connector including a detecting member provided on one of said housings and movable from a retracted to an advanced condition, the latch preventing movement of the detecting member when in the non-locking position, and permitting movement of the detecting member when in the locking position, and the connector further including a short-circuit releasing member adapted to cause or release a short-circuit condition between terminals of the other of said housings, wherein said short-circuit releasing member is engageable by said detecting member on movement from the retracted to the advanced condition, to move from a short-circuiting condition to a state in which the short-circuit condition is released, wherein said short-circuit releasing member includes a resilient arm, and said detecting member deflects said arm during movement from the retracted to the advanced condition, thereby to release said short-circuit, and wherein said short-circuit releasing member is 'U' shaped, a resilient arm being constituted by each free end thereof.

2. An electrical connector according to claim 1 wherein the tips of each free end of the short-circuit releasing member include ramp faces for engagement with a short-circuit member of the other of said housing.

3. An electrical connector according to claim 1 wherein the arms of said short-circuit releasing member are deflected apart by said detecting member in the advanced condition.

4. An electrical connector according to claim 3 wherein the tips of each free end of the short-circuit releasing member include ramp faces for engagement with a short-circuit member of the other of said housings.

5. An electrical connector, comprising two housings adapted for mutual fitting and having a resilient latch movable to a locking position to retain said housings in a fitted condition, and movable to a non-locking position during movement of said housings through a half-fitted condition, the connector including a detecting member provided on one of said housings and movable from a retracted to an advanced condition, the latch preventing movement of the detecting member when in the non-locking position, and permitting movement of the detecting member when in the locking position, and the connector further including a short-circuit releasing member adapted to cause or release a short-circuit condition between terminals of the other of said housings, wherein said short-circuit releasing member is engageable by said detecting member on movement from the retracted to the advanced condition, to move from a short-circuiting condition to a state in which the short-circuit condition is released, said housings being engageable on an attachment axis, said detecting member being movable perpendicular to the direction of said axis from the retracted to the advanced condition, and said short-circuit releasing member being movable in a direction at right angles to said attachment axis and to the direction of movement of said detecting member in response to movement of said detecting member.

6. An electrical connector according to claim 5 wherein said short-circuit releasing member is insertable in one of said housings in the direction of said attachment axis.

7. An electrical connector according to claim 6 wherein said short-circuit releasing member includes a protrusion extending in the direction of said axis and engageable in an aperture of said one of said housings to prevent movement thereof in the plane at right angles to said axis.

8. An electrical connector, comprising two housings adapted for mutual fitting and having a resilient latch movable to a locking position to retain said housings in a fitted condition, and movable to a non-locking position during movement of said housings through a half-fitted condition, the connector including a detecting member provided on one of said housings and movable from a retracted to an advanced condition, the latch preventing movement of the detecting member when in the non-locking position, and permitting movement of the detecting member when in the locking position, and the connector further including a short-circuit releasing member adapted to cause or release a short-circuit condition between terminals of the other of said housings, wherein said short-circuit releasing member is engageable by said detecting member on movement from the retracted to the advanced condition, to move from a short-circuiting position to a state in which the short-circuit condition is released, wherein said detecting member is resiliently latchable in the retracted and in the advanced conditions.

9. An electrical connector, comprising two housings adapted for mutual fitting and having a resilient latch movable to a locking position to retain said housings in a fitted condition, and movable to a non-locking position during movement of said housings through a half-fitted condition, the connector including a detecting member provided on one of said housings and movable from a retracted to an advanced condition, the latch preventing movement of the detecting member when in the non-locking position, and permitting movement of the detecting member when in the locking position, and the connector further including a short-circuit releasing member adapted to cause or release a short-circuit condition between terminals of the other of said housings, wherein said short-circuit releasing member is engageable by said detecting member on movement from the retracted to the advanced condition, to move from a short-circuiting condition to a state in which the short-circuit condition is released, wherein said detecting member is movable in the advanced condition into a bending space of said latch thereby to prevent movement of said latch when in the locking position.

* * * * *